US006401355B1

(12) United States Patent
Linnonmaa et al.

(10) Patent No.: US 6,401,355 B1
(45) Date of Patent: Jun. 11, 2002

(54) METHOD AND APPARATUS FOR MANUFACTURING CALENDERED PAPER

(75) Inventors: Pekka Linnonmaa, Järvenpää ; Antti Heikkinen, Helsinki, both of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/743,673

(22) PCT Filed: Jul. 12, 1999

(86) PCT No.: PCT/FI99/00616

§ 371 (c)(1),
(2), (4) Date: Jan. 10, 2001

(87) PCT Pub. No.: WO00/03088

PCT Pub. Date: Jan. 20, 2000

(30) Foreign Application Priority Data

Jul. 10, 1998 (FI) ..... 981594
Nov. 27, 1998 (FI) ..... 982582

(51) Int. Cl.[7] ..... D06F 58/00
(52) U.S. Cl. ..... 34/114; 100/38
(58) Field of Search ..... 34/116, 114, 117, 34/446, 119, 122; 118/224; 162/207, 136, 198, 206; 324/32; 226/92; 100/38, 335

(56) References Cited

U.S. PATENT DOCUMENTS

| | | | | | |
|---|---|---|---|---|---|
| 3,735,929 | A | | 5/1973 | Pleines | 239/341 |
| 3,948,721 | A | | 4/1976 | Winheim | 162/207 |
| 4,096,311 | A | | 6/1978 | Pietreniak | 428/289 |
| 4,596,633 | A | | 6/1986 | Attwood | 162/206 |
| 4,653,395 | A | * | 3/1987 | Verkasalo | 100/38 |
| 4,749,445 | A | * | 6/1988 | Vreeland | 100/38 |
| 4,986,883 | A | | 1/1991 | Taipale et al. | 162/205 |
| 5,245,920 | A | | 9/1993 | Hess | 100/38 |
| 5,321,899 | A | * | 6/1994 | Kade et al. | 34/114 |
| 5,378,497 | A | | 1/1995 | Johnson et al. | 427/211 |
| 5,470,436 | A | * | 11/1995 | Wagle et al. | 162/207 |
| 5,483,873 | A | * | 1/1996 | Koivukunnas et al. | 100/38 |
| 5,557,860 | A | | 9/1996 | Kotitschke et al. | 34/455 |
| 5,771,603 | A | * | 6/1998 | Kotitschke et al. | 34/446 |
| 5,862,613 | A | * | 1/1999 | Kerttula et al. | 34/446 |
| 5,884,415 | A | * | 3/1999 | Sims et al. | 34/117 |
| 5,896,813 | A | * | 4/1999 | Nikulainen et al. | 100/335 |
| 5,933,977 | A | * | 8/1999 | Deshpande et al. | 34/116 |
| 6,193,840 | B1 | * | 2/2001 | Elijoki et al. | 162/136 |
| 6,200,422 | B1 | * | 3/2001 | Shakespeare et al. | 162/198 |
| 6,200,424 | B1 | * | 3/2001 | Saari et al. | 162/205 |

FOREIGN PATENT DOCUMENTS

| | | | | |
|---|---|---|---|---|
| CA | 2110786 | | 9/1997 | |
| DE | 19901400 | * | 7/2000 | D21F/5/00 |
| DE | 19903581 | * | 8/2000 | D21H/25/08 |
| FI | WO-0079049 | * | 12/2000 | D21G/1/00 |

* cited by examiner

*Primary Examiner*—Teresa Walberg
*Assistant Examiner*—Leonid M Fastovsky
(74) *Attorney, Agent, or Firm*—Steinberg & Raskin, P.C.

(57) ABSTRACT

A method and apparatus for manufacturing calendered paper in which the paper is calendered after drying. The paper is dried (D) sown to a moisture lower that the target moisture of calendering. The paper is run via wetting (1) to calendering, wherein at least one of the surface layer of the paper is wetted in the wetting in such that the moistening water is absorbed in the surface layer of the paper while at lest the central part remains substantially dry. From the paper wetted at least on one of its sides, gradient paper is manufactured by means of gradient calendering by restricting the paper-molding effect of the calender to the wetted surface layer in such a way that at least the paper is elastically restored substantially in its original state, whereafter the obtained gradient paper is reeled.

22 Claims, 7 Drawing Sheets

- PRIOR ART -

METHOD AND APPARATUS FOR MANUFACTURING CALENDERED PAPER

FIELD OF THE INVENTION

The invention relates to a method for manufacturing calendered paper. The invention also relates to an apparatus for manufacturing calendered paper.

BACKGROUND OF THE INVENTION

After the paper has been dried, the surface structure of the web is made suitable by means of a mechanical treatment, calendering. There are several calendering methods, but it is common to all of them that the web is passed through one or several nips which are formed between two surfaces, typically between rotating roll surfaces. The purpose of the calendering is to improve the paper quality by pressing the paper into a fixed final thickness, and especially by smoothing its surface. As is well known, humidity improves the mouldability of the fibres contained in the paper in connection with the calendering. Because of this, the calendering is conducted in a fixed moisture content, "the target moisture of calendering".

In the following, the calendering processes of certain SC-grades will be described.

Conventionally, SC-paper is manufactured in an off-line process. The paper is dried, "overdried", in the paper machine to a moisture of about 2 to 4%. Thereafter the paper is wetted to a calendering moisture of 8 to 12% before reeling up. It is typical for the process that the moisture has the time to equalize itself during the standing time of the reel in the z-direction (i.e., perpendicular to a surface of the paper) of the paper before calendering. In this context, the standing time refers to the time between the manufacturing time and the beginning of calendering.

In present on-line multi-roll calender applications of SC-grades the paper is dried in the drying section to the target moisture of calendering. Generally, it is typical for these processes that the paper is passed directly to the calender in the final target moisture of 8 to 12%, even 15%.

Normally, when paper is calendered, its surface is smoothed and glazed in the expense of the thickness of the paper. The controlled variable used in the calender is the linear load and/or nip pressure, which determines the quality of the surface of the paper as well as the final thickness. Especially in connection with printing papers with low grammage it has been impossible to implement such calendering in which the thickness of the paper would not be substantially reduced when aiming to the desired surface quality.

Up to the present, only theories have been presented as to how such a structure of the paper could be attained that the calendering work would be focused on the surface layers of the web, while the density in the central part of the web would remain nearly in its original state, i.e. the calendering would restore its "bulkiness". Generally, the theories could be referred to by the term gradient calendering. It has not been established by anyone in a watertight manner that the manufacture of so-called gradient paper would be possible with printing papers.

The purpose of the invention is to present a real practical method for manufacturing calendered paper, the end product of which is a gradient calendered paper.

The method is based on heavy drying of the body moisture of paper, i.e. so-called overdrying, and on the wetting of this overdried paper before calendering in such a way that the wetting is conducted on a moving web, which is guided towards the calender. In this context, overdrying refers to the act of drying the paper to a lower moisture than the moisture normally allowed for the paper when the paper enters the calender nip, when it is taken into account that in the calendering, the moisture of the web is reduced further by over 2 percentage points, wherein the paper attained after calendering is dryer than the moisture of use of paper in normal conditions. The wetting is conducted at a suitable distance from the calender, so that when the web speed of the paper is taken into account, the moistening water has the time to be absorbed in the surface of the paper. On the other hand, the metering is conducted in such a way that the moistening water is absorbed only in the surface layer of the web, while the central layer remains substantially dry (in the moisture of an overdried web).

OBJECTS AND SUMMARY OF THE INVENTION

In the method, it is possible to use both on-line calendering and off-line calendering. In the former case, the web is overdried in the drying section of the paper machine and passed to the calender via wetting. In the latter case, the web is overdried in the drying section and reeled in a reel-up to form a reel, whereafter it is unwound to the calender via wetting.

The calender is advantageously a multi-nip calender which has several successive nips between the calender rolls, which exert a determined nip pressure on the web passed through the nip. To manufacture good printing paper grades, calenders with over 4 nips are typically used.

The apparatus includes a wetting device which is placed at a suitable distance from the calender. There may be wetting devices on both sides of the web to wet both sides of the web. Both wetting devices are located within a suitable distance from the calender, wherein the result is a symmetrically gradient calendered paper, in which the density of both surface layers is higher than the density of the central layer.

BRIEF DESCRIPTION OF THE DRAWINGS

In the following, the invention will be illustrated with reference to the appended drawings, in which.

DETAILED DESCRIPTION OF THE PREFERRED EMBODIMENTS

Figure 1:
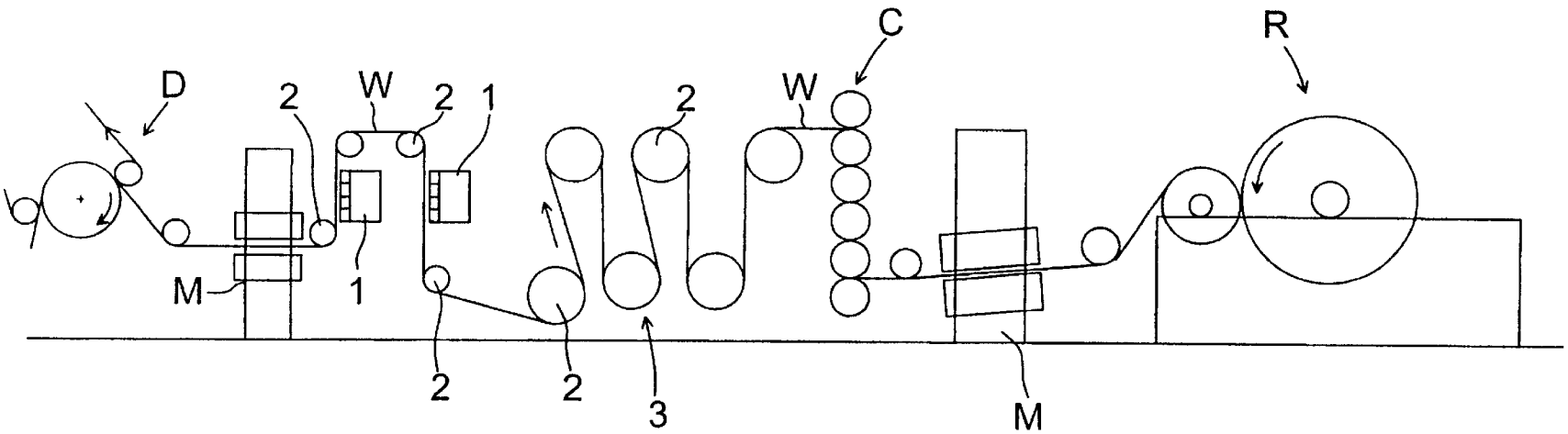
FIG. 1 shows a schematical side-view of the apparatus.

FIG. 1 shows an apparatus which is provided with rolls 2 or the like to guide a web W passed from the drying section D of a paper machine to a calender C, the web W having been overdried to a moisture lower than the inlet moisture, i.e. the target moisture of calendering. The drying section D is a multi-cylinder dryer with a known principle. The calender C is a multi-nip calender in which successive nips are formed between the rolls superimposed in a stack of calender rolls. The structure of the calender can be any of those used in on-line multi-nip calenders. Advantageously, it contains over 4 nips, and FIG. 1 shows a calender with 6 rolls and 5 nips. It is also possible to use a calender with 8, 10, or 12 rolls, and 7, 9 or 11 nips, respectively. In a known manner, the calender also comprises rolls with metal and polymer surfaces. After the calender the paper web W is reeled in a reel-up R to form a machine reel.

The apparatus comprises a wetting device 1 which is located between the drying section D and the calender C in the travel direction of the web. The wetting device 1 is arranged to wet the surface of the web W with a known method. The wetting device is arranged sufficiently far before the calender C in the travel direction of the web, so that the water would have the time to be absorbed in the surface layer of the web. The wetting device 1 is advantageously a water moistener which meters a suitable amount of moistening water on the surface of the web. The moistener is for example a roll moistener or a spray moistener, or any other moistener by means of which water is introduced on the surface of the paper, and the water can also be in the form of steam or a mixture of steam and liquid water. In this context, moistening water refers to all aqueous substances, either pure water or water containing substances dissolved or suspended therein.

As can be seen in FIG. 1, there are two wetting devices 1, one on each side of the web W, and they are arranged to conduct a two-sided wetting of the web in such a way that the central layer remains substantially dry, i.e. in an over-drying moisture which the paper possesses after the drying section D. FIG. 1 also shows devices M for measuring the moisture profile of the web, by means of which devices it is possible to monitor and adjust the moisture. The first measuring device M is located before the wetting devices 1 and the second measuring device after the calender C.

Figure 2:
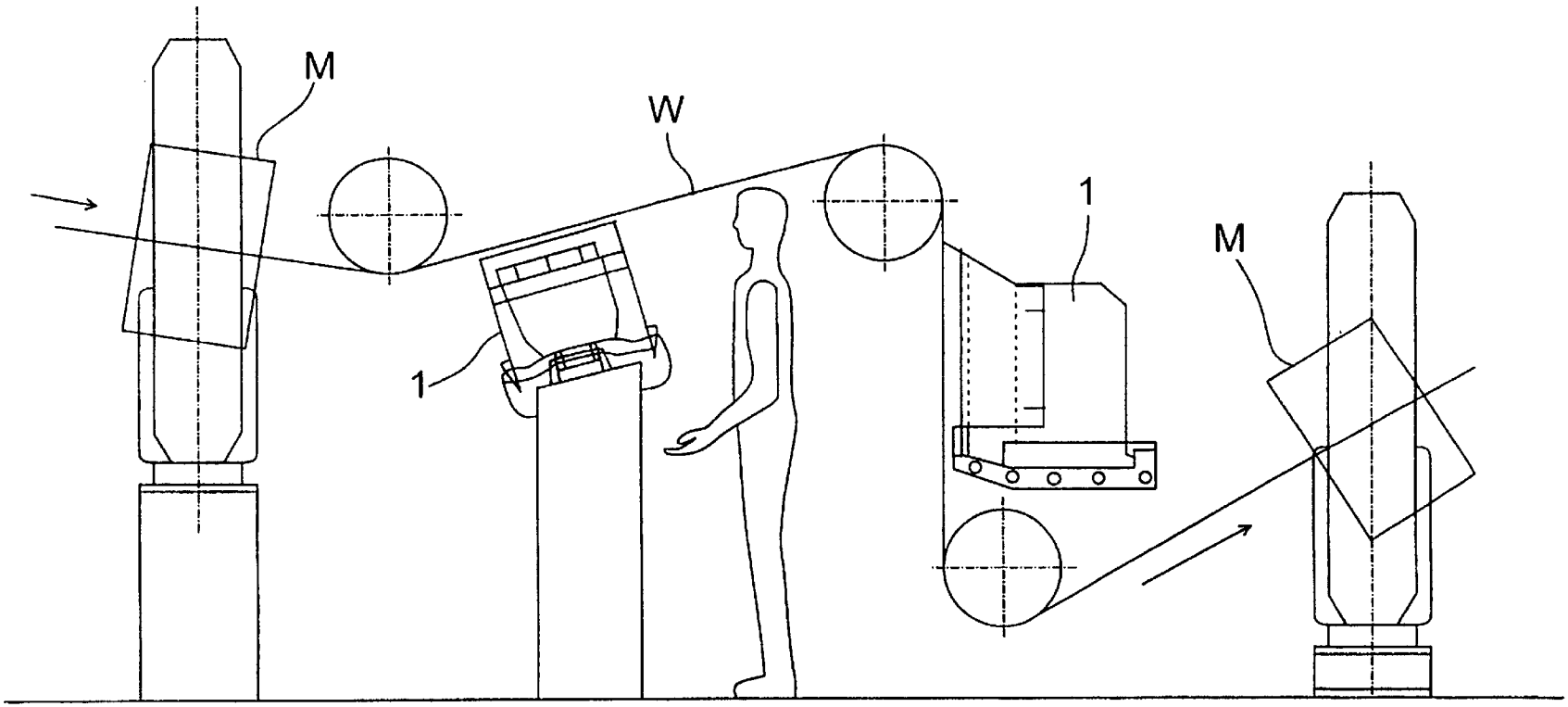
FIG. 2 shows a side-view of a part of the apparatus, located before the calender.

FIG. 2 shows a detail of an apparatus similar to the one shown in FIG. 1 for implementing two-sided wetting, in which apparatus the devices M for measuring the moisture profile are located before and after the wetting devices, the latter measuring device being located before the calender C.

Within the scope of the present invention, the moisture of the web refers to the ratio of its water content to the entire mass. It is typical for the calendering process succeeding the wetting that the process is a gradient calendering process. The gradient is attained in the paper by drying it down to a moisture of 0 to 7% and by re-wetting it to the target moisture of 7.5 to 20% (total moisture). The web is advantageously dried down to a moisture of 2 to 4%, and re-wetted advantageously to the target moisture of 8 to 12%. Typically, the wetting is conducted immediately before the calender C within a sufficient residence time from the first calender nip, unlike before, when re-wetting was conducted before reeling up. The placement of the wetting device/s 1 to attain a sufficient delay time is determined in accordance with the absorption time required by the water. In this context, the absorption time refers to the time after which an optimal calendering result is attained in the paper after applying water on the paper. The absorption time is 0.2 to 2.0 s. In relation to the web speeds used for printing papers, such as e.g. SC-papers, the location point of the wetting device 1 is typically 5 to 40 m, advantageously 5 to 35 m before the calender when measured along the path travelled by the web. FIG. 1 shows an adjustment device 3 located between the wetting devices 1 and the calender C, by means of which adjustment device 3 it is possible to increase the length of path travelled by the web W from the wetting point to the calender C and correspondingly the absorption time, and it is also possible to change these two. The adjustment device 3 is provided with elements, e.g. rolls, guiding the travel of the web, and by changing the distance between them especially in the vertical direction, it is possible to alter the aforementioned distance within a wide range. Similarly, it is possible to guide the web to travel along another route, by making the web to pass by some rolls of the roll system. The absorption time is sufficiently long so that the water has the time to spread in the surface layer, but it does not wet the paper thoroughly as is the case in the wetting conducted before off-line calendering when the web is waiting on the reel.

It is typical for the wetting device 1 that it produces a sufficiently even film or a layer of water on the surface of the paper. In connection with a spray moistener, it is a known fact that the average droplet size has to be in accurate proportion to the water amount to be sprayed. Typically, when the water amounts are 0.1 to 10 g/m$^2$, it is advantageous to use an average droplet size of approximately 10 to 100 $\mu$m.

When wetting is effected both on the upper and the lower side of the web, it is possible to adjust the wetting devices 1 on the basis of the measurement results obtained after the calendering. The measuring devices M located after the calender C can thus measure the properties on both sides of the web from the web passing by. In addition to the moisture, the measuring devices can also measure gloss and/or smoothness, wherein their sensors can be placed within the same measuring frame, or they may be located in different measuring frames between the calender C and the reel-up R. Thus, the amount of water added in the wetting can be adjusted on the basis of the measurement result (gloss and/or smoothness) on the corresponding side, and thus from the measuring device M there is correspondingly a feedback connection to the wetting device. If a particular two-sidedness is desired for the paper, the wetting on the upper side is adjusted to differ from the wetting on the lower side in order to attain the desired two-sidedness. Similarly, it is possible to use the measuring device M measuring the moisture, which is located after the calender, to measure whether the target final moisture is realized after the calendering, and the wetting on the upper side and the lower side can be adjusted in such a way that the desired two-sidedness is restored in their relation, but at the same time they wet together the paper web W in such a way that the desired final moisture remains in the paper after the calendering.

The invention is especially well suited for SC-paper grades. In the following, the quality requirements of some wood-containing SC-paper grades will be presented as examples.

| grade | brightness | opacity (%) | gloss (%) | smoothness PPS10 | density kg/m$^3$ | porosity Bendtsen |
|---|---|---|---|---|---|---|
| SC-A | 67 | 93 | 40–45 | 1.0–1.2 | 1100–1200 | below 20 |
| SC-B | 67 | 93 | 30–35 | 1.4–1.6 | 1000 | 40 |
| SC-C | 67 | 93 | 25–30 | 1.8–2.5 | 800 | 60 |

The grades SC-A, SC-B and SC-C differ from each other primarily in respect of pulps used as a raw material.

FIGS. 4 to 9 illustrate the final result attained by means of the method according to the invention. The experiments have been conducted with a multi-nip calender comprising polymer and steel rolls, the x-axis of the figures showing the nip pressure of the lowest (last) nip. The nip pressure is converted from the linear load with the Hertz formula, and it shows the average nip pressure in the nip. Dry paper with the moisture of approximately 2 to 3% was calendered by wetting both sides in such a way that the moisture was approximately 5% after the calendering. The absorption time of water before the first calender nip was approximately 1 s.

The effect of the moisture gradient on the quality of the paper is substantially dependent on the steepness of the gradient. When the central parts of the paper are dry, they behave more elastically in pressing than wet surfaces. Thus, most of the paper-moulding effect of the calender is restricted to wet surfaces. After the pressing, the central part is elastically restored nearly into its original state. Thus, in the calendering the surfaces become relatively tighter than the centre of the paper.

Figure 3:
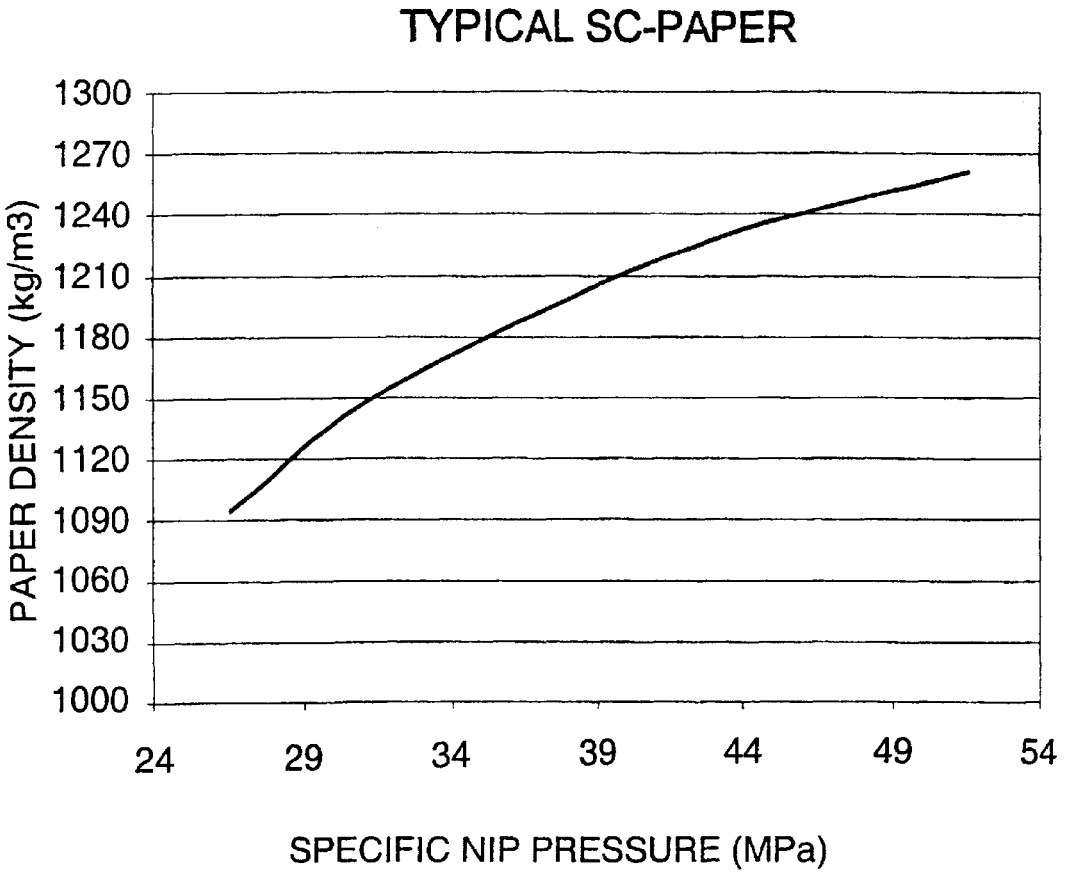
FIG. 3 shows a calendering curve of prior art.
Figure 4:
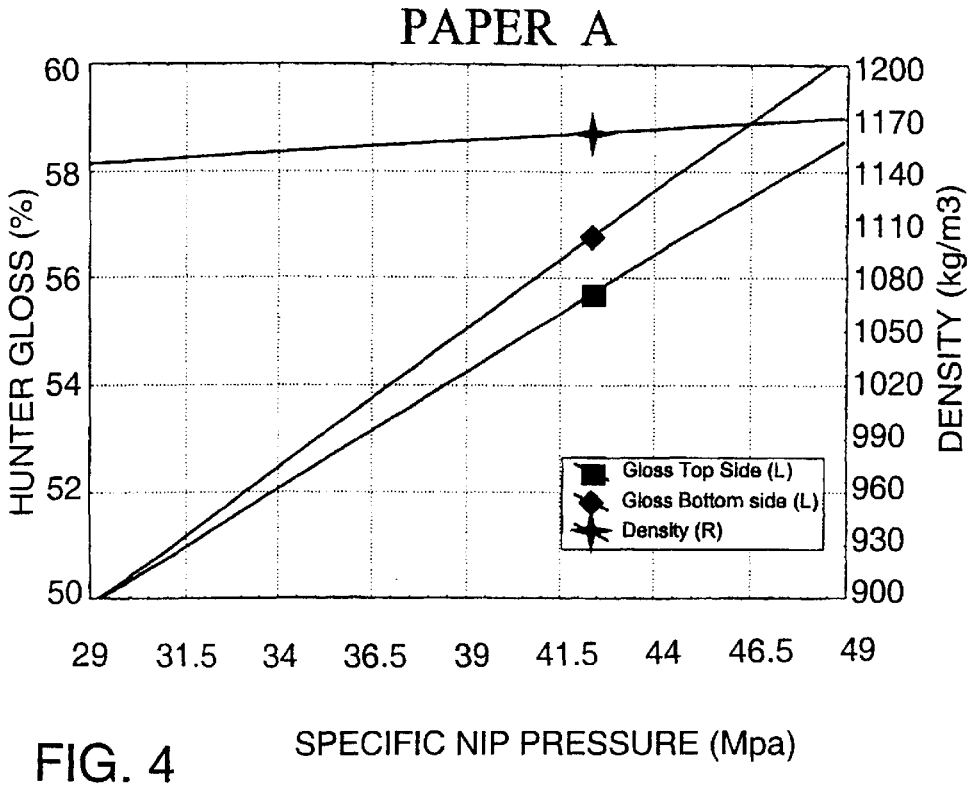
FIGS. 4 to 9 show the calendering curves attained with the method according to the invention.
Figure 5:
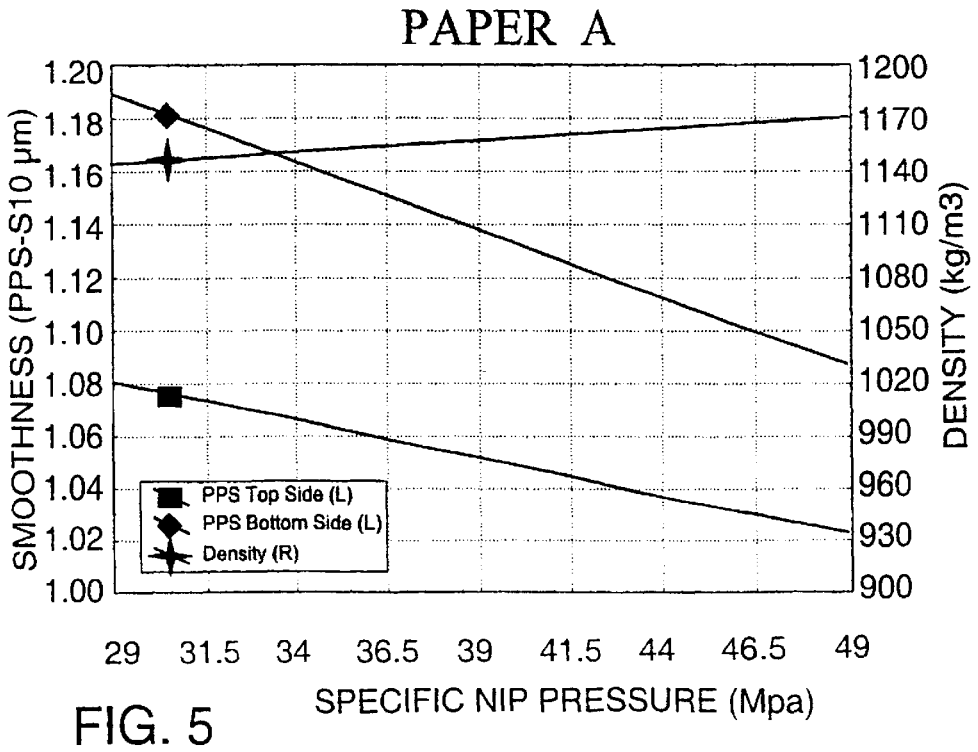
Figure 6:
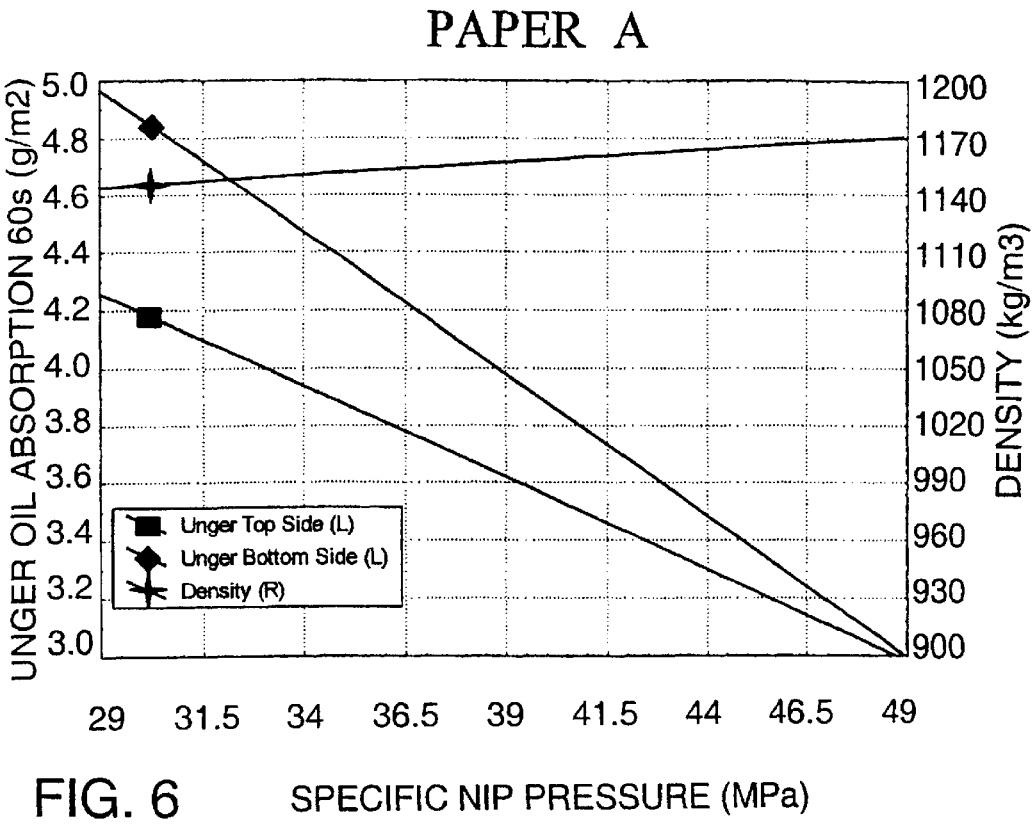
Figure 7:
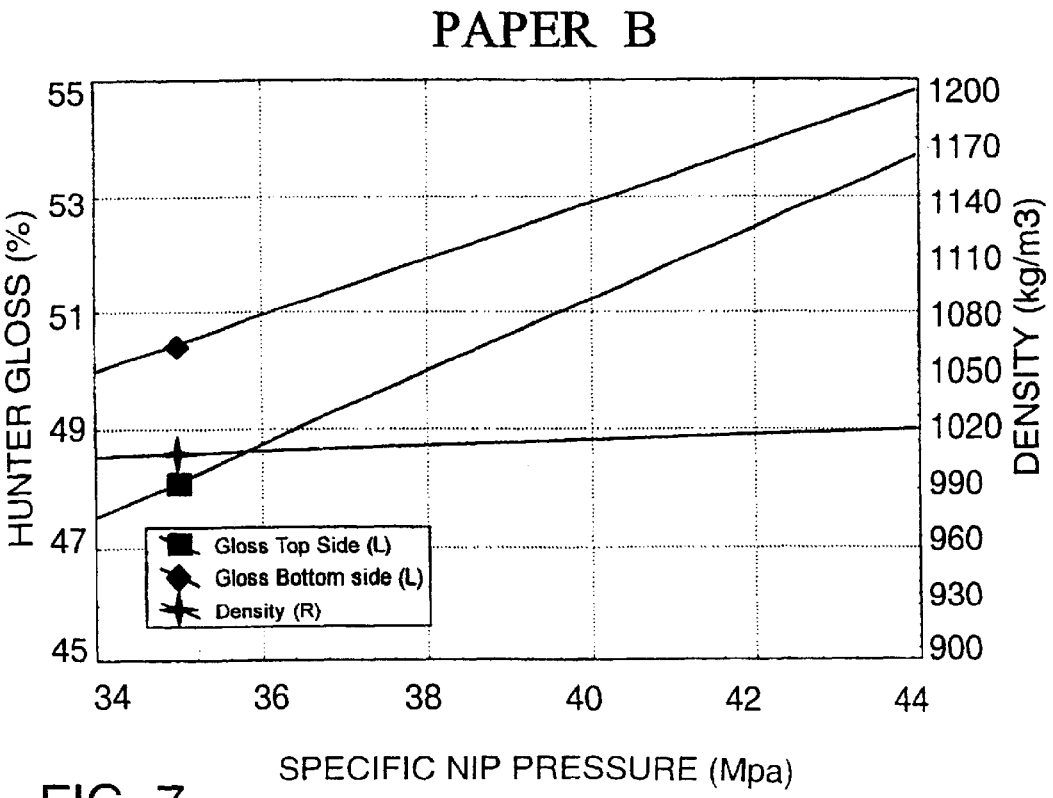
Figure 8:
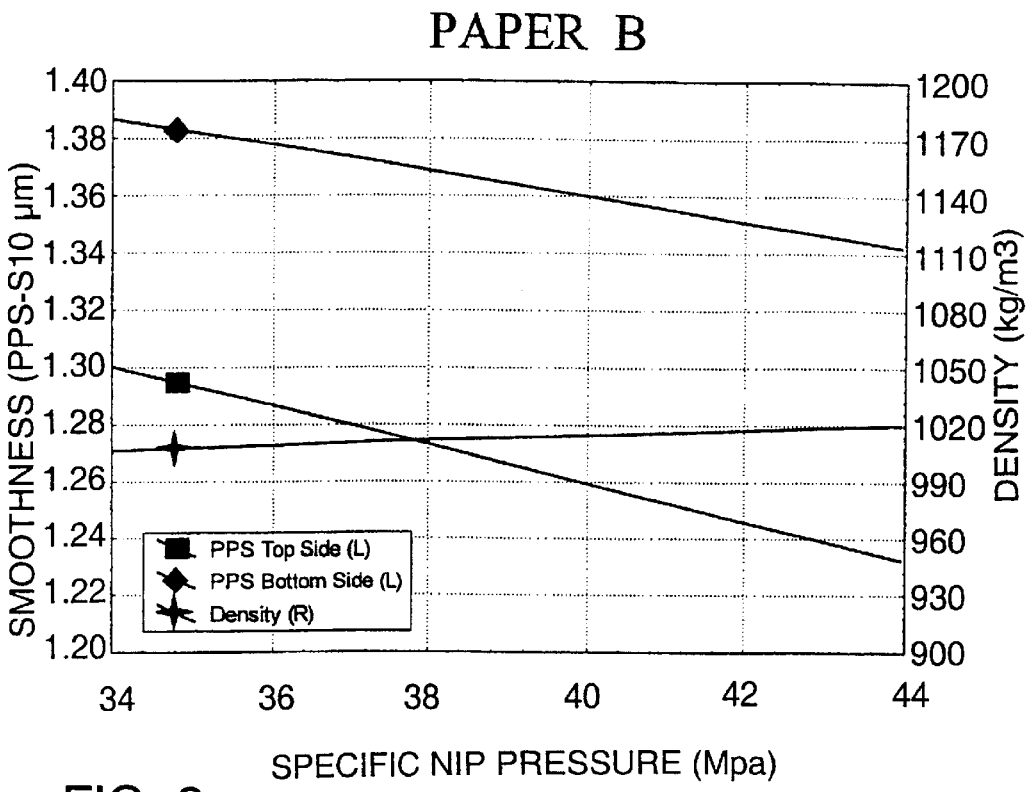
Figure 9:
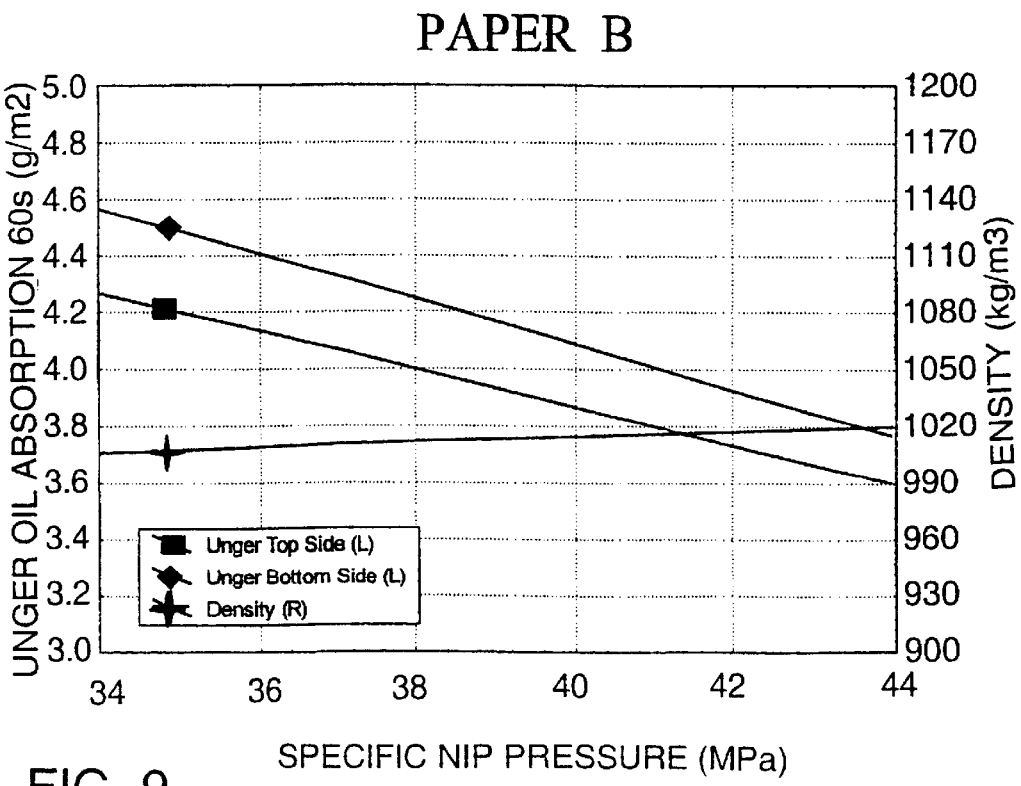

FIG. 3 presents a typical calendering curve when the paper has a relatively uniform moisture in the z-direction, i.e. in the thickness direction. The density of the paper increases steeply as a function of the calendering pressure.

Typical features of papers of FIGS. 4 to 9, manufactured by means of the gradient calendering method according to the invention, include in turn lower density, greater thickness and a higher stiffness target in the quality of the surface, such as gloss and smoothness, when compared to paper of FIG. 3, manufactured under same conditions but with an uniform moisture distribution. In these papers the density is increased only to a small degree as a function of the calendering pressure, which indicates that the "bulkiness" in the central layer of the web is preserved and a clear density gradient is obtained for the paper in the thickness direction of the web.

In the figures, paper A is offset paper with the aim of good gloss. Paper B is offset paper, with the aim of brightness in addition to the gloss, and it is manufactured of bleached pulp.

It can be seen in the drawings that within the nip pressure area of 30 to 50 MPa, the density in SC-papers gradient calendered on both sides increases less than 2.0 kg/m$^3$ per 1 MPa (the slope of the line illustrating the density as a function of the nip pressure), whereas in conventionally calendered SC-paper (FIG. 3) it increases within the same range 6 kg/m$^3$ on the average per 1 MPa and even at its smallest the increase in the upper end of the pressure range is over 3.5 kg/m$^3$ per 1 MPa. In the lines of FIGS. 4 to 9, the exactly calculated value is below 1.5. kg/m$^3$ per 1 MPa.

Figure 10:
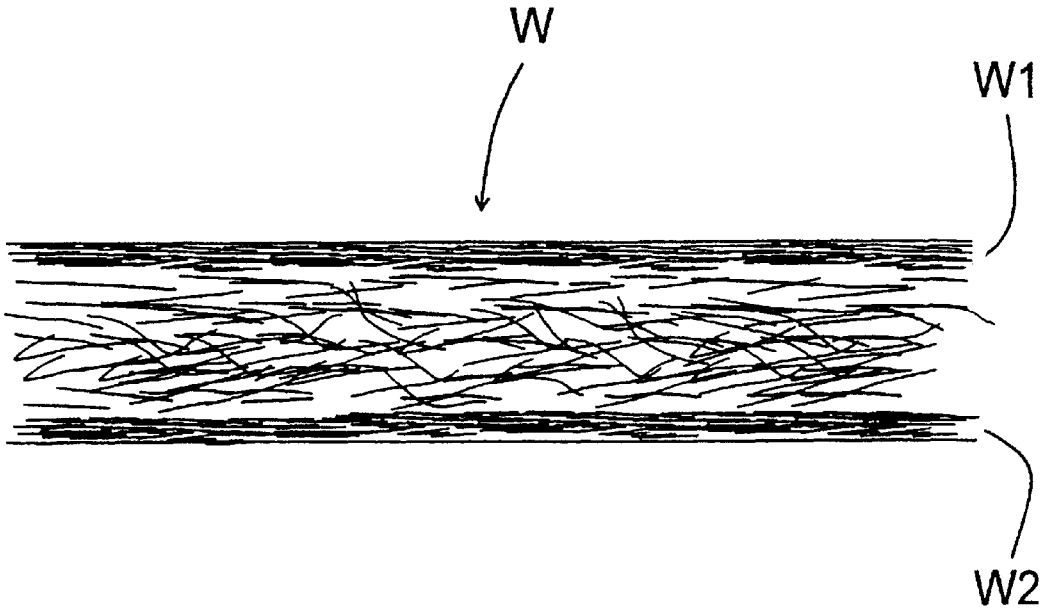
FIG. 10 illustrates the structure of the paper attained with the method according to the invention.

FIG. 10 shows schematically the cross-section of gradient calendered paper. The drawing shows surface layers W1, W2 which are more dense than the central layer of original density. It is, however, possible that the wetting required by gradient calendering is conducted only on the other side of the web, wherein the more dense surface layer is only on one side of the paper.

Hereinabove, reference has been made to wetting and consequently to the gradient calendering effect in connection with on-line calendering, but this can also be implemented in off-line calendering in a supercalender. The arrangements and advantageous parameters can otherwise be the same as those shown in FIG. 1 and mentioned in the description above, but the web W is passed from an unwinding device to the supercalender via wetting device/s.

The present invention has been described herein with reference to preferred embodiments of the invention however the description provided herein is for illustrative purposes and should not be considered to be exhaustive. It is understood that modifications and variations of the above describe preferred embodiments are possible without departing from the spirit or scope of the present invention.

What is claimed is:

1. Apparatus for manufacturing calendered (SC) paper from a paper web (W), comprising:

a multi-nip calender (C);

means for guiding said paper web (W) to said multi-nip calender;

at least one wetting device (1) structured and arranged along a travel path of the paper web (W) for wetting of said paper web (W) dried to a moisture content below a target moisture for calendering, wherein said at least one wetting device (1) is structured and arranged a distance before said multi-nip calender (C) in a web running direction and structured and arranged to apply a moistening water onto a surface of the paper web at such a speed that the absorption of said moistening water by said paper web is restricted to said surface layer of said paper web.

2. The apparatus according to claim 1, comprising:

at least one wetting device (1) on either side of said paper web (W).

3. The apparatus according to claim 1, wherein said at least one wetting device (1) is structured and arranged from about 5 to 40 meters before the multi-nip calender (C) measured along a distance traveled by said paper web.

4. The apparatus according to claim 1, wherein said at least one wetting device (1) is structured and arranged from about 5 to 35 meters before the multi-nip calender (C) measured along a distance traveled by said paper web.

5. Method for manufacturing calendered (SC) paper from a paper web (W) in a paper machine, comprising the steps of:

drying of said paper web (W) down to a moisture content level lower than a target moisture content level for calendering;

wetting of at least one surface layer of said dried paper web (W) with a moistening water after said drying, wherein said paper web is wetted up to said target moisture content level for calendering such that said moistening water is absorbed in said surface layer and wherein a central portion of said paper web remains substantially dry;

gradient multi-nip calendering of said paper web (W) having said target moisture content level for calendering, wherein a paper-molding effect of said calender with respect to said wetted surface layer of said paper web is restricted such that at least said central portion of said paper web is elastically restored to a state substantially equal to a state of said central portion prior to said gradient multi-nip calendering thereby resulting in a gradient (SC) paper; and reeling of said gradient (SC) paper.

6. The method according to claim 5, comprising the steps of:

calendering said paper web (W) on-line; and running said paper web (W) from said drying to said wet-nip calendering via said wetting.

7. The method according to claim 5, comprising the steps of:

calendering said paper web (W) off-line; and running said paper web (W), having a moisture content level lower than said target moisture content level, from said drying to a reel-up and then from said reel-up to said wet-nip calendering via said wetting.

8. The method according to claim 5, comprising the steps of:

drying said paper web (W) to a moisture content level below 7%; and wetting said paper web (W), before said calendering, to a target moisture content level of above 7.5%.

9. The method according to claim 8, comprising the step of:

drying said paper web (W) to a moisture content level of between about 2 to 4%.

10. The method according to claim 8, comprising the step of:

wetting said paper web (W), before said calendering, to a target moisture content level of about 8 to 12%.

11. Method for manufacturing calendered (SC) paper from a paper web (W) in a paper machine, comprising the steps of:

drying of said paper web (W) down to a moisture content level lower than a target moisture content level for calendering;

wetting of at least one surface layer of said dried paper web (W) with a moistening water after said drying, wherein said paper web is wetted up to said target moisture content level for calendering such that said moistening water is absorbed in said surface layer and wherein a central portion of said paper web remains substantially dry;

gradient multi-nip calendering of said paper web (W) having said target moisture content level for calendering, wherein a paper-molding effect of said calender with respect to said wetted surface layer of said paper web is restricted such that a density difference in a thickness direction of said paper web (W) is obtained in said paper web (W) while at least said central portion of said paper web remains at a density which is lower than a density of said surface layer thereby resulting in a gradient (SC) paper; and reeling of said gradient (SC) paper.

12. The method according to claim 11, comprising the steps of:

multi-nip calendering said paper web (W) on-line; and running said paper web (W) from said drying to said multi-nip calendering via said wetting.

13. The method according to claim 11, comprising the steps of:

multi-nip calendering said paper web (W) off-line; and running said paper web (W), having a moisture content level lower than said target moisture content level, from said drying to a reel-up and then from said reel-up to said multi-nip calendering via said wetting.

14. The method according to claim 11, comprising the steps of:

drying said paper web (W) to a moisture content level below 7%; and wetting said paper web (W), before said calendering, to a target moisture content level of above 7.5%.

15. The method according to claim 14, comprising the step of:

drying said paper web (W) to a moisture content level of between about 2 to 4%.

16. The method according to claim 14, comprising the step of:

wetting said paper web (W), before said multi-nip calendering, to a target moisture content level of about 8 to 12%.

17. The method according to claim 5, wherein the multi-nip calender has over four nips.

18. The method according to claim 5, wherein in the multi-nip calender successive nips are formed between rolls superimposed in a stack of calender rolls, which include rolls with metal and polymer surfaces.

19. The method according to claim 5, wherein said multi-nip calendering is conducted in over four nips.

20. The method according to claim 5, wherein said multi-nip calendering is conducted in successive nips which are formed between rolls superimposed in a stack of calender rolls, which include rolls with metal and polymer surfaces.

21. The method according to claim 5, wherein said multi-nip calendering is conducted in over four nips.

22. The method according to claim 5, wherein said multi-nip calendering is conducted in successive nips which are formed between rolls superimposed in a stack of calender rolls, which include rolls with metal and polymer surfaces.

* * * * *